US011464330B2

(12) United States Patent
Felsenthal et al.

(10) Patent No.: US 11,464,330 B2
(45) Date of Patent: Oct. 11, 2022

(54) PIVOT ADJUSTABLE SHOE RACK

(71) Applicant: Whitmor, Inc., Southaven, MS (US)

(72) Inventors: Sandy Felsenthal, Memphis, TN (US); James Tabujara, Memphis, TN (US)

(73) Assignee: Whitmor, Inc., Southaven, MS (US)

( * ) Notice: Subject to any disclaimer, the term of this patent is extended or adjusted under 35 U.S.C. 154(b) by 0 days.

(21) Appl. No.: 17/174,228

(22) Filed: Feb. 11, 2021

(65) Prior Publication Data

US 2021/0244179 A1 Aug. 12, 2021

Related U.S. Application Data

(60) Provisional application No. 62/975,129, filed on Feb. 11, 2020.

(51) Int. Cl.
*A47B 45/00* (2006.01)
*A47B 61/04* (2006.01)

(52) U.S. Cl.
CPC ..... *A47B 45/00* (2013.01); *A47B 61/04* (2013.01)

(58) Field of Classification Search
CPC ..... A47B 61/04; A47B 45/00; A47L 23/20
USPC ..... 211/34–38
See application file for complete search history.

(56) References Cited

U.S. PATENT DOCUMENTS 1,724,386 A * 8/1929 Weston ..... A47F 5/13 211/85
1,733,487 A * 10/1929 Hackley ..... A47B 61/04 211/35
1,874,056 A * 8/1932 Matallana ..... A47B 61/04 211/38
1,927,997 A * 9/1933 Turner ..... A47F 7/08 211/38
1,995,383 A * 3/1935 Fischer ..... A47B 61/04 211/37
2,276,141 A * 3/1942 Atkinson ..... A47L 23/20 211/37
2,294,504 A * 9/1942 Knape ..... A47F 7/08 211/38
2,431,423 A * 11/1947 Robbins ..... A47B 45/00 211/37
3,022,897 A * 2/1962 Archer ..... A47F 7/08 211/36
3,888,353 A * 6/1975 Leifheit ..... A47B 61/04 211/37

(Continued)

FOREIGN PATENT DOCUMENTS

CH 342348 A * 11/1959 ..... A43D 117/00
DE 2265126 A1 * 5/1976 ..... A47B 61/04

(Continued)

*Primary Examiner* — Stanton L Krycinski
(74) *Attorney, Agent, or Firm* — Stites & Harbison PLLC; Richard S. Myers, Jr.

(57) ABSTRACT

A storage rack for articles such as shoes and the like, comprising a left frame and an opposed right frame, with each frame including at least one side rail; a front support bar that engages a side rail of the left frame and the right frame; a rear support bar that engages a side rail of the left frame and the right frame; wherein the front side rail comprises a hinge that engages the side rail and permitting movement of the front side rail from a first position to a second position relative to the side rail, which remains stationary.

13 Claims, 6 Drawing Sheets

(56) References Cited

U.S. PATENT DOCUMENTS 5,172,816 A * 12/1992 Kline ..... A47B 87/0207 211/194
5,617,959 A * 4/1997 Klein ..... A47B 61/04 211/34
5,992,647 A * 11/1999 Malik ..... A47B 45/00 211/194
6,247,602 B1 * 6/2001 Klein ..... A47B 61/04 211/189
D462,539 S * 9/2002 Segall ..... D6/681.1
6,464,087 B1 * 10/2002 Klein ..... A47B 96/16 211/113
6,533,127 B1 * 3/2003 Klein ..... A47B 61/04 211/118
6,786,337 B2 * 9/2004 Klein ..... A47F 5/01 211/134
6,877,614 B2 * 4/2005 Hu ..... A47B 45/00 211/34
7,000,787 B2 * 2/2006 Felsenthal ..... A47F 5/137 211/105.3
7,249,679 B2 * 7/2007 Klein ..... A47F 7/08 211/175
7,249,680 B2 * 7/2007 Wang ..... A47B 57/04 211/150
7,762,406 B2 * 7/2010 Qiang ..... A47B 61/04 211/38
7,832,571 B2 * 11/2010 Felsenthal ..... A47B 47/027 211/134
8,636,156 B2 * 1/2014 Malik ..... A47B 96/16 211/119.004
9,756,939 B1 * 9/2017 Ruiz ..... A47B 43/04
10,136,727 B2 * 11/2018 Freelander ..... A43D 117/00
10,531,735 B1 * 1/2020 Lucio ..... A47B 57/04
2006/0049121 A1 * 3/2006 Klein ..... A47B 61/04 211/35
2007/0138113 A1 * 6/2007 Haberman ..... A47B 96/06 211/35
2008/0135509 A1 * 6/2008 Jackson ..... A47B 57/54 211/123
2010/0066222 A1 * 3/2010 Ito ..... A47B 61/04 312/326
2019/0098995 A1 * 4/2019 Brown ..... A47B 61/04
2021/0076818 A1 * 3/2021 Felsenthal ..... A47B 96/02

FOREIGN PATENT DOCUMENTS

DE 202014100471 U1 * 4/2014 ..... A47B 45/00
DE 102016000975 A1 * 8/2017 ..... A47B 61/04
FR 1206143 A * 2/1960 ..... A43D 117/00
FR 1462095 A * 12/1966 ..... A47B 61/04
GB 1072036 A * 6/1967 ..... A47L 23/20

* cited by examiner

PIVOT ADJUSTABLE SHOE RACK

PRIOR APPLICATIONS

This application claims benefit to U.S. Patent Application No. 62/975,129, filed Feb. 11, 2020; the contents of which are incorporated herein by reference in their entirety.

Field of the Invention

The present invention relates to rack for storing items such as a shoe. In embodiments of the present invention, the storage rack has an adjustable base that allows for convenient storage of various styles and sizes of articles.

SUMMARY OF THE INVENTION

An embodiment of the present invention is a simple and effective system for storing shoes. The shoe rack of the present invention is adjustable to allow for convenient storage of various styles and sizes of shoes.

Embodiments of the present invention are stackable. Other embodiments of the present invention are extendible. Other embodiments of the present invention are both stackable and extendable.

One embodiment of the present invention is a storage rack for articles such as shoes or the like, that comprises a left frame and an opposed right frame, with each frame including at least one side rail; a front support bar that engages a side rail of the left frame and the right frame; a rear support bar that engages a side rail of the left frame and the right frame; wherein the front side rail comprises a hinge that engages the side rail and permitting movement of the front side rail from a first position to a second position relative to the side rail, which remains stationary.

In other embodiments, the left frame and the right frame are four sided, and the side rail engages two of the sides.

In other embodiments, the left frame and the right frame each include a pair of side rails, each side rail engaging two sides of the frames.

In other embodiments, the side rails are generally parallel to one another.

In other embodiments, the front support bar and the rear support bar are generally parallel.

In other embodiments, the support bars are further apart from one another in the first position than in the second position.

In other embodiments, the rear support bar is stationary.

In other embodiments, the side rails are uneven in height so that the front support bar is lower than the rear support bar.

In other embodiments, the hinge is a bar attached to the side rail at a pivot point, and the front support moves about the pivot point from the first position to the second.

In other embodiments, the side rail further comprises a notch, and the first support bar rests in the notch when moved from the first position to the second position.

In other embodiments, the frames comprise protrusions, upon which the frame rests. Also, the top of the frames may comprise notches that correspond to the protrusions such that the notches can receive and hold the protrusions of a second storage rack that is stacked upon the first storage rack.

In other embodiments, the support bars are tubular.

In yet another embodiment, the support bars can be telescopically extended lengthwise to increase and decrease the length of the rack.

BRIEF DESCRIPTION OF THE FIGURES

It should be understood that the drawings are provided for the purpose of illustration only and are not intended to be construed as defining the limits of the invention. The foregoing and other objects and advantages of the embodiments described herein will become apparent with reference to the following and detailed description when taken in conjunction with the accompanying drawings.

DESCRIPTION OF THE INVENTION

As stated above, an embodiment of the present invention is a simple and effective system for storing articles such as shoes. The storage rack of the present invention is adjustable to allow for convenient storage of various styles and sizes of articles.

An example of an article that can be conveniently stored with the present invention is shoes.

Embodiments of the rack of the present invention comprise support bars that are adjustable in length. Also, embodiments of the present invention comprise knobs and recesses that allow multiple racks to be securely stacked. Also, embodiments of the present invention are extendible so that the rack can be extendable to adjustable lengths.

Figure 1:
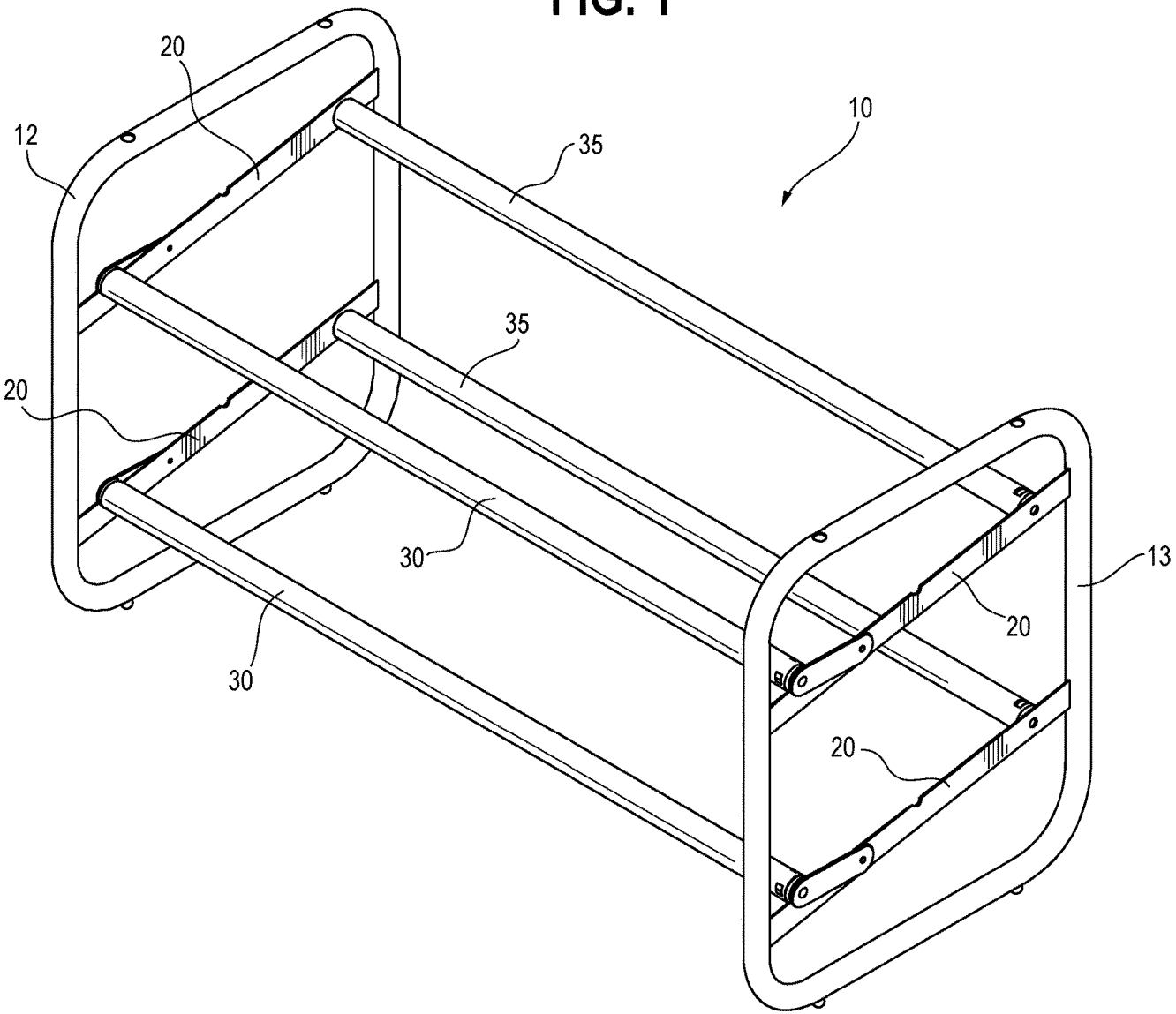
FIG. 1 is a perspective view of an embodiment of a storage rack of the present invention.

Turning to the figures, FIG. 1 shows a perspective view of an embodiment of the rack 10 of the present invention. The left frame 12 and the right frame 13 support the side rails 20. In this embodiment, each frame 12, 13 has two side rails. However, more or fewer side rails are contemplated. The side rails hold the front support bar 30 and the rear support bar 35.

The rack of the present invention can be made from a variety of materials. For example, rack can be wood, plastic, metal, or combinations thereof. For example, the frames, side rails, and support bars may be plastic and the other materials may be metal. Preferably, the entire rack is metal. Additionally, the frames and support bars may be metallic and tubular. Tubular support bars especially accommodate the telescoping feature discussed below.

Figure 2:
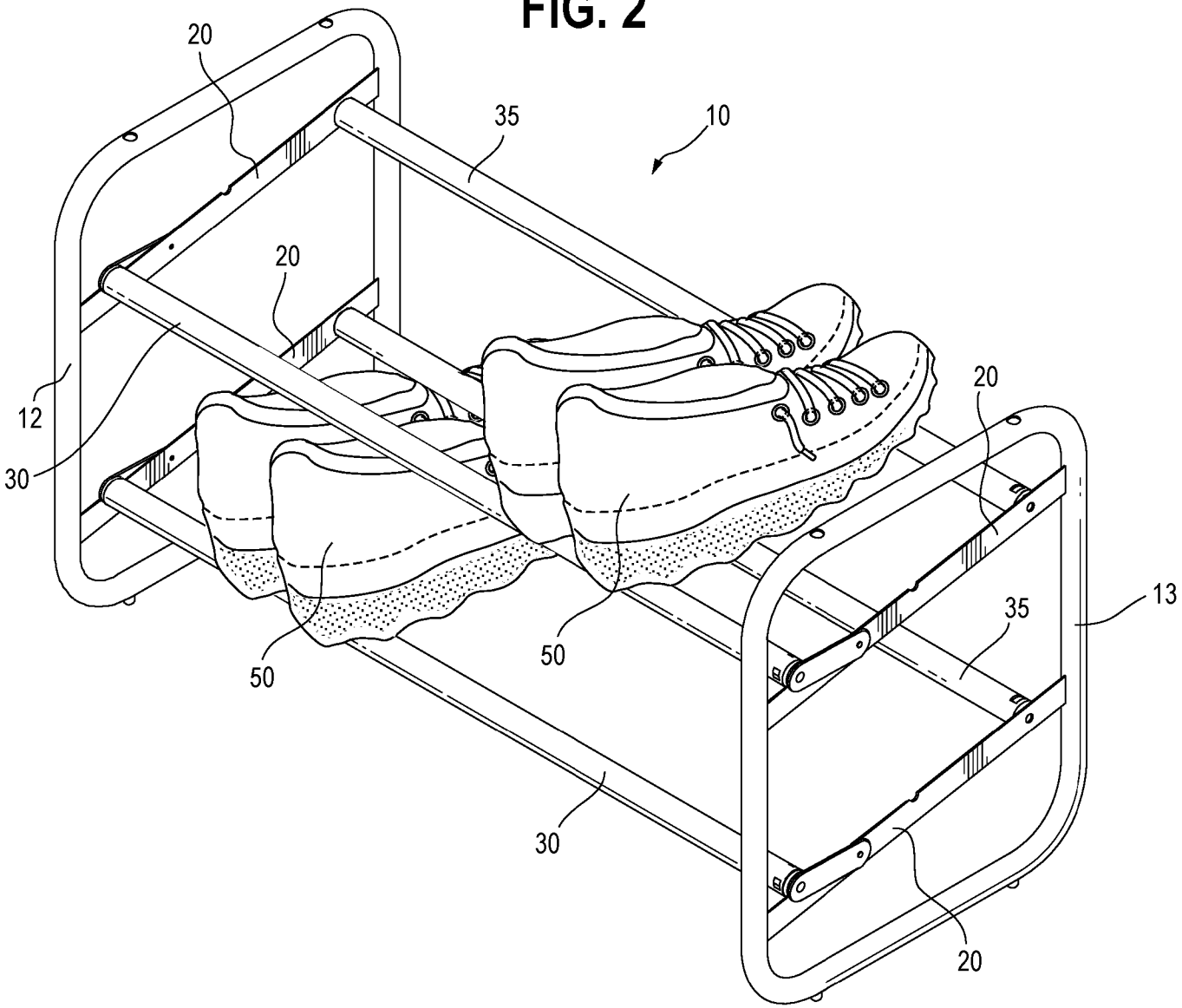
FIG. 2 is a perspective view of an embodiment of the present invention, showing how shoes may be stored on the rack.

FIG. 2 is a perspective view of the rack of the present invention that is the same view as FIG. 1. The left frame 12 and the right frame 13 are shown, and is the side rails 20. This figure also shows an example of the present invention in use. Here, the front support bar 30 and the rear support bar 35 are supporting shoes 50. The soles of the shoes rest on the support bars.

Figure 3:
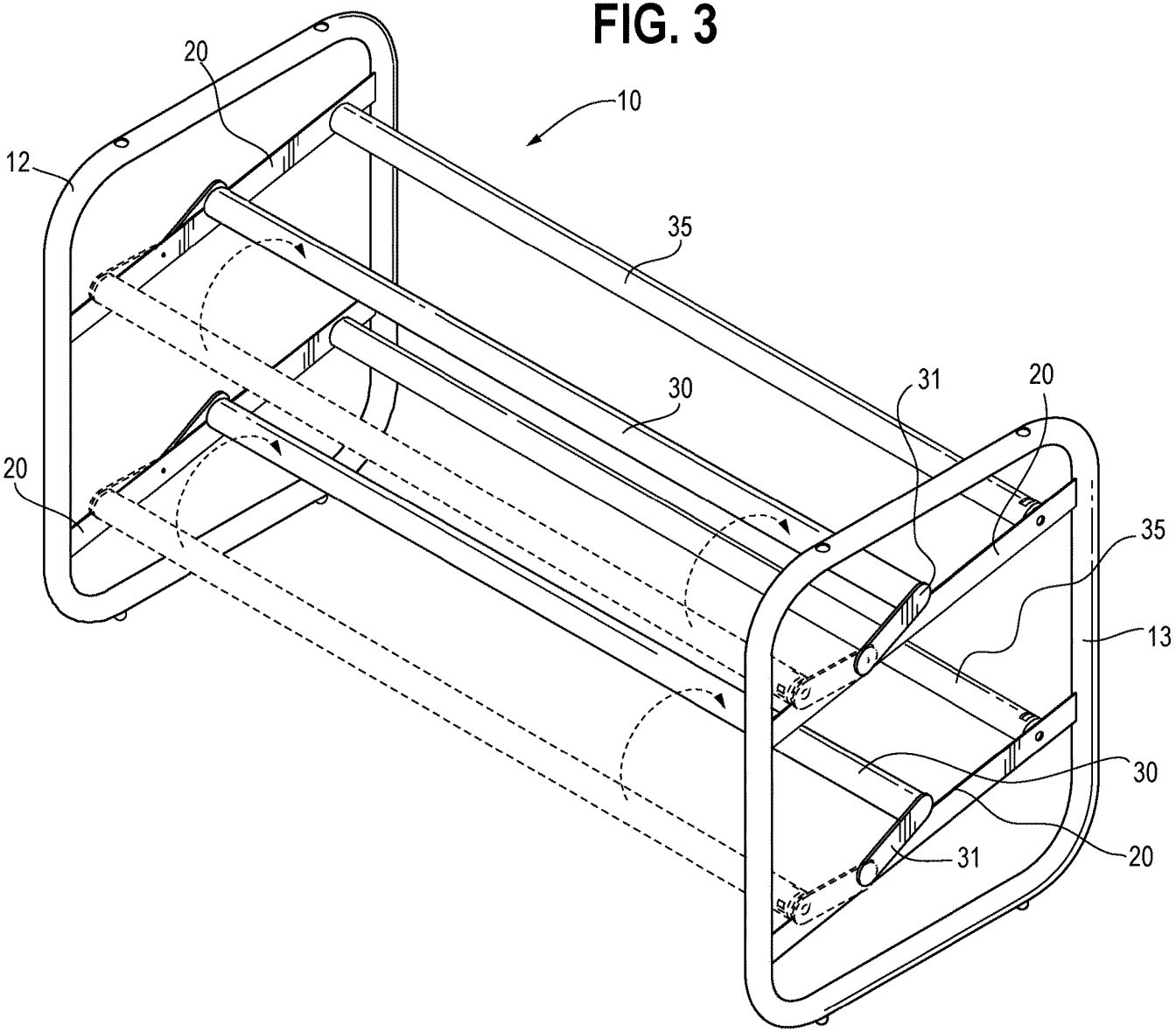
FIG. 3 is a perspective view of the present invention, showing how a front support bar can pivot from a first position to a second position.

FIG. 3 shows an important feature of the present invention. In this embodiment, the front support bar 30 comprises a hinge or bracket 31 that is attached to the side rail 20. The bracket 31 pivots at the attachment point to allow the front support bar 30 to move from a first position (shown with dashes in the figure) to a second position. The second position is closer to the second support bar 35. The bracket, hinge, etc., is effectively a joint that holds two parts together so that the front support bar 30 can swing from the first position to the second position relative to the side rail.

Among other things, this feature allows smaller devices to be stored on the rack 10. For example, men's shoes, women's shoes, and kid's shoes can be stored on the same rack. It also allows articles of different types of shoes to be stored on the device. For example, shoes with different types can be stored on the same device. One example of a different type of shoe is a high heel shoe. A user can flip the front support bar 30 from the first position to the second position, allowing for the heel to placed behind the front support bar 30 while the front of the sole can rest on the rear support bar 35. One of the primary features of the present invention is that it can change from storing small shoes to large shoes easily and quickly. Also, each shelf is independent. Accordingly, if the rack has two shelves, the bottom shelf can be in the first position while the top shelf can be in the second position.

The hinge 31 can be attached to the side rail 20 in any number of ways, and is not critical. The only requirement is that the hinge be attached in a way to allow the front support bar 30 to be securely attached to the side rail and swing between the two positions. Typically, the front support bar will rest on the side rail in the first position, and then rest on the side rail in the second position. A rivet, for example allows the front support bar to be attached in a secure manner and also allow movement from the first position to the second.

The rear support bar 35 is typically attached to the side rail in a fixed, stationary manner.

Figure 4:
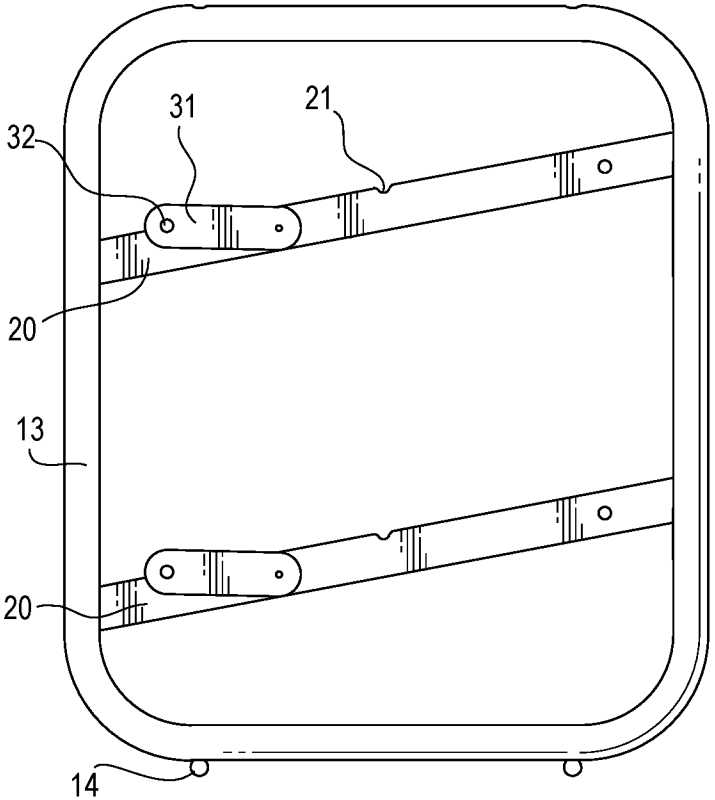
FIG. 4 is a side view of an embodiment of the present invention, showing both the upper and lower front support bars in the first positon.

FIG. 4 is a side view of an embodiment of the present invention. It shows the front support bar comprises a hinge 31, and is resting in a first position. The support bar is attached to the hinge by an attachment device 32, such as a bolt, rivet, etc. In embodiments of the invention, the side rail 20 can also include a notch 21 to receive the front support bar 20 or the attachment device 32 to help hold it in place after it pivots to the second position. Also shown in this embodiment, the side rail 20 is attached to the frame 13 at an angle. Also shown in Figure is protrusions 14 in the bottom of the frame that will be shown in greater detail infra. The protrusions 14 facilitate stacking of multiple devices.

Figure 5:
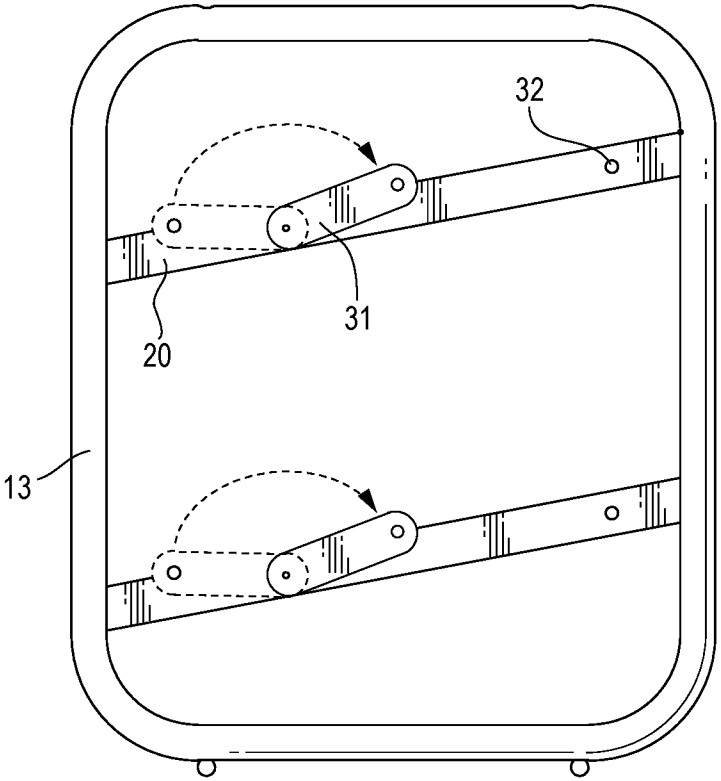
FIG. 5 is a side view of an embodiment of the present invention, showing both the upper and lower front support bars pivoting from a first positon to a second position.

FIG. 5 also shows side view of the embodiment of FIG. 4, with the front support bar 30 in a second position.

Figure 6:
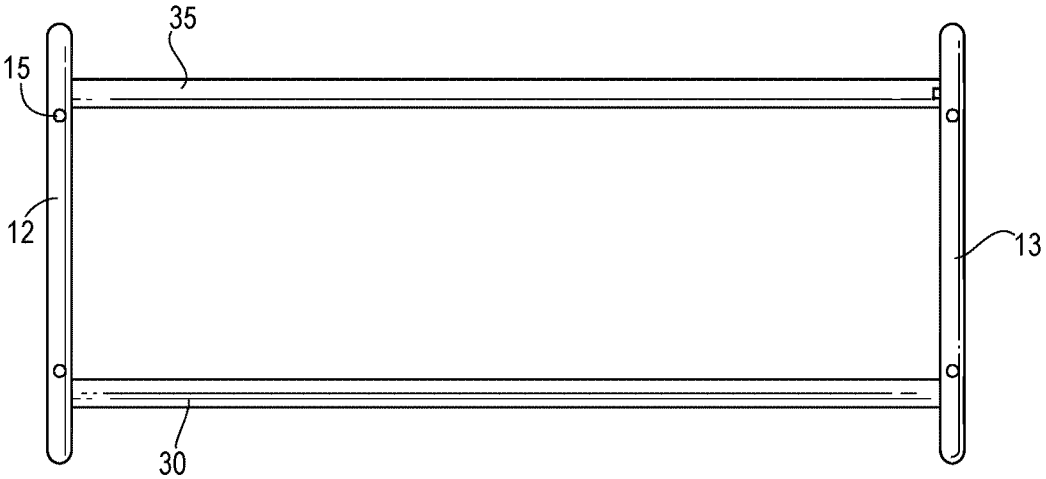
FIG. 6 is top view of an embodiment of the present invention.

FIG. 6 is a top view of an embodiment of the present invention. It shows the apertures 15 that can receive the protrusions (not shown in this figure). The protrusions and apertures allow the units to be easily stacked.

Figure 7:
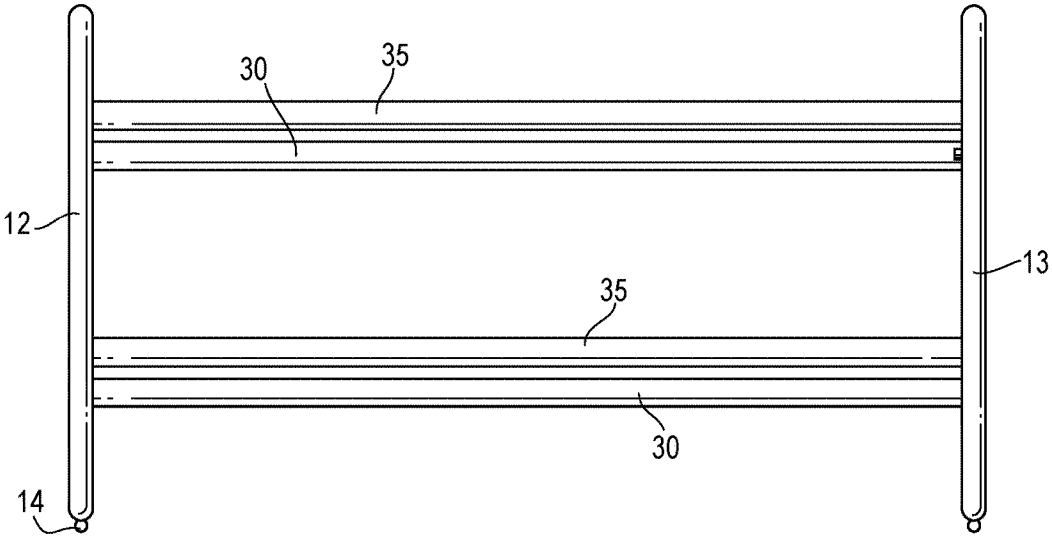
FIG. 7 is front elevation view of the present invention.

FIG. 7 is a front view of an embodiment of the present invention. The side rails (not shown in this figure) are attached to the frame at an angle. This allows for the shoes or other items stored thereon to be at an angle. FIG. 7 shows this arrangement is shown because the front support bar 30 appears to be below the rear support bar 35.

Figure 8:
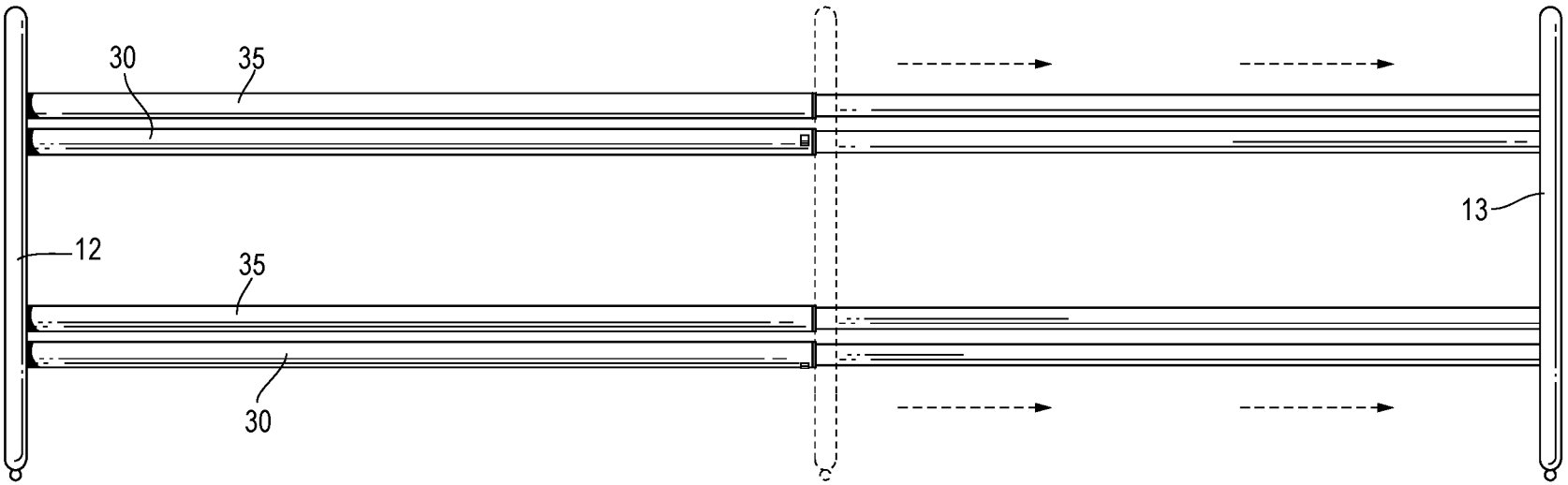
FIG. 8 is front elevation of the present invention, showing the support rails extending from a shortened position to an extended position.

FIG. 8 is also a front view of the present invention. It shows an additional embodiment, where the front support bar 30 and the rear support bar 35 are telescoping. This allows for the rack to be expandable in length.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

It should also be noted that elements of embodiments may be described in reference to the description of a particular embodiment; however it is disclosed that elements of disclosed embodiments can be switched with corresponding elements of embodiments with the same name and/or number of other disclosed embodiments.

The invention thus being described, it would be obvious that the same can be varied in many ways. Such variations that would be obvious to one of ordinary skill in the art is to be considered as being part of this disclosure.

We claim:

1. A storage rack, comprising:

a left frame having a front and a back, and including at least one side rail, the side rail being attached to the front and back, and the front and back being separated by the length of the side rail;

a right frame having a front and a back, and including at least one side rail, the side rail being attached to the front and back, and the front and back being separated by the length of the side rail;

a front support bar that engages a side rail of the left frame and a side rail of the right frame;

a rear support bar that engages a side rail of the left frame and a side rail of the right frame;

wherein the front support bar comprises a hinge that engages the side rail of the left frame and a hinge that engages the side rail of the right frame, permitting movement of the front support bar from a first position to a second position relative to the side rail of the left frame and the side rail of the right frame, which remains stationary; and wherein the support bars are further apart from one another in the first position than in the second position.

2. The storage rack of claim 1, wherein the left frame and the right frame are four sided, with said front, said back, a top, and a bottom.

3. The storage rack of claim 1, wherein the left frame includes two side rails, each side rail engaging two sides of the left frame; and the right frame includes two side rails, each side rail engaging two sides of the right frame.

4. The storage rack of claim 1, wherein the side rails are generally parallel to one another.

5. The storage rack of claim 1, wherein the front support bar and the rear support bar are generally parallel.

6. The storage rack of claim 1, wherein the rear support bar is stationary.

7. The storage rack of claim 1, wherein each side rail is uneven in height so that the front support bar is lower than the rear support bar.

8. The storage rack of claim 1, wherein the front support has two hinges; one hinge being attached to the left side rail at a pivot point and one hinge being attached to the right side rail at a pivot point, and the front support bar moves about the pivot points from the first position to the second.

9. The storage rack of claim 8, wherein the side rails further comprise a notch, and the hinges of the first support bar rests in the notch when moved from the first position to the second position.

10. The storage rack of claim 1, wherein the frames comprise protrusions, upon which each frame rests.

11. The storage rack of claim 10, wherein the top of the frames comprise notches that correspond to the protrusions such that the notches can receive and hold the protrusions of a second storage rack that is stacked upon the first storage rack.

12. The storage rack of claim 1, wherein the support bars are tubular.

13. The storage rack of claim 12, wherein the support bars can be telescopically extended lengthwise to increase and decrease the length of the rack.

* * * * *